US007530340B1

(12) United States Patent
Jellinek et al.

(10) Patent No.: US 7,530,340 B1
(45) Date of Patent: May 12, 2009

(54) REMOVABLE LINKAGE OF A MODIFIED CORDLESS POWER DRILL FOR GASOLINE ENGINES TO POWER-ASSIST STARTING OF GASOLINE ENGINES

(76) Inventors: Max Jellinek, 452 White Birchway, Hazelwood, MO (US) 63042; Joseph Tricamo, 43 Circle View Dr., Fenton, MO (US) 63026

( * ) Notice: Subject to any disclaimer, the term of this patent is extended or adjusted under 35 U.S.C. 154(b) by 0 days.

(21) Appl. No.: 12/156,098

(22) Filed: May 29, 2008

(51) Int. Cl.
*F02N 11/00* (2006.01)

(52) U.S. Cl. ..... 123/179.25; 74/7 B; 123/179.1; 123/179.26

(58) Field of Classification Search ..... 123/179.1, 123/179.24, 179.25, 179.26, 179.27, 185.1, 123/DIG. 3; 74/7 B, 7 R
See application file for complete search history.

(56) References Cited

U.S. PATENT DOCUMENTS

| | | | | |
|---|---|---|---|---|
| 2,901,911 A | | 9/1959 | Duncan | |
| 2,932,292 A | | 4/1960 | Trotter et al. | |
| 3,365,596 A | | 1/1968 | Jones | |
| 3,437,083 A | * | 4/1969 | Hamman | 123/179.26 |
| 3,537,436 A | * | 11/1970 | Heisler | 123/179.26 |
| 3,596,647 A | * | 8/1971 | Heisler | 123/179.26 |
| 3,645,247 A | | 2/1972 | D'Ambrosio | |
| 3,885,544 A | | 5/1975 | Pfeiffer | |
| 4,339,782 A | | 7/1982 | Yu et al. | |
| 4,372,263 A | | 2/1983 | Costa | |
| 4,531,482 A | | 7/1985 | Scheckel | |
| 4,569,315 A | | 2/1986 | Bodnar | |
| 5,345,900 A | | 9/1994 | Wisegerber | |
| 6,253,722 B1 | | 7/2001 | Robinson et al. | |

* cited by examiner

*Primary Examiner*—Stephen K Cronin
*Assistant Examiner*—David Hamaoui
(74) *Attorney, Agent, or Firm*—Bryan Cave, LLP

(57) ABSTRACT

The invention provides a system for providing power assisted starting for a variety of gasoline engine devices. In one embodiment, a device comprises a drill having a chuck, a hex shank socket extension coupled to the chuck and a tube. The tube has two dowel pins and the tube is coupled to the drill such that the tube encircles the hex shank socket extension. The tube is configured to couple to an anchor device configured around the hex nut of a bolt securing a flywheel of a gasoline engine.

7 Claims, 5 Drawing Sheets

REMOVABLE LINKAGE OF A MODIFIED CORDLESS POWER DRILL FOR GASOLINE ENGINES TO POWER-ASSIST STARTING OF GASOLINE ENGINES

FIELD OF INVENTION

The present invention relates to a modified cordless electric power drill, and more specifically to methods and systems for providing power assisted starting for a variety of gasoline engine devices.

BACKGROUND OF THE INVENTION

The present invention relates to a modified cordless electric power drill, and more specifically to methods and systems for providing power assisted starting for a variety of gasoline engine devices.

Many gasoline engines use a pull-cord in which a cord is wound about a pulley which is coupled to the engine's crankshaft. Using the pull-cord to start an engine requires a certain level of physical strength and range of motion. Because of this, many people have difficulty using a pull-cord to start an engine. Accordingly, various mechanical starters have been developed to help start gasoline engines.

Such prior art devices have included expensive and complex power starting units such as those utilizing a starter ring and Bendix drive with an electric starter and battery. Although these units work satisfactorily, battery charging and replacements are cumbersome while permanently mounted in the device, they increase weight and the initial cost of the lawn mower. In an attempt to devise a more economically feasible starter, prior proposals have suggested using a coupler to connect an electric drill to the crankshaft to provide the torque needed to turn the crankshaft. Certain of these devices have proved to be hazardous to operate due to the difficulty in disengaging the coupler from the engine once the engine is started. Certain embodiments also required a special mounting structure on the lawn mower which required modifying the existing crankshaft configuration.

In previous patents, an uncovered hex shank socket extension with a linkage device has been used to engage an existing hex nut of the bolt securing a flywheel to its crankshaft. This open configuration may cause safety concerns upon removal of the starter as kick-back from the starter device caused injuries. For example, U.S. Pat. No. 3,596,647 disclosed a large rig to hold a drill in place. This rig is only applicable, however, for larger equipment and lacks a shielding device for the rotating linkage mechanism. Other systems employ a simple clutch to assist in the disengagement of the linkage of the starter mechanism. However, these clutches also failed to remedy the danger associated with kick-back. For example, U.S. Pat. No. 4,365,596 discloses a sleeved drive shaft that rotates upon withdrawal from the linkage. Moreover, the device disclosed in the '596 patent does not provide any mechanism for locking the starter in place to prevent kick-back.

For the foregoing reasons, there is a strong need for a system for providing power assisted starting for a variety of gasoline engine devices that provides adequate shielding for the user to alleviate safety concerns. The present invention provides these and other advantageous results.

SUMMARY OF THE INVENTION

The present system provides methods and systems for providing power assisted starting for a variety of gasoline engine devices. In one embodiment, a device comprises a drill having a chuck, a hex shank socket extension coupled to the chuck and a tube. The tube has two dowel pins disposed on opposite sides of the tube at a first end on the tube, and the second end of the tube is coupled to the drill such that the tube encircles the hex shank socket extension. The device further comprises an anchor that is configured to encircle the hex nut of a bolt securing a flywheel of a gasoline engine. The anchor comprises two hemispherical sidewalls that form a circle, and wherein the hemispherical sidewalls further form two elongate slots on opposite sides of the circle. The tube is configured to fit within the anchor circle and the two tube dowel pins are configured to engage within the two elongate slots of the circle.

The invention described herein provides several advantages. For example, a tubular linkage is configured to provide safety by securing the starter device to the engine device. Another advantage of the invention is to provide a removable starter that will not add any additional weight to the equipment after the equipment's engine has been starting. The invention also is cost effective because it can be used to start a wide variety of equipment.

BRIEF DESCRIPTION OF THE DRAWINGS

The invention will be better understood from a reading of the following detailed description, taken in conjunction with the accompanying Figures in the drawings in which.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

DETAILED DESCRIPTION OF THE INVENTION

The detailed description of exemplary embodiments of the invention herein makes reference to the accompanying drawings, which show the exemplary embodiment by way of illustration and its best mode. While these exemplary embodiments are described in sufficient detail to enable those skilled in the art to practice the invention, it should be understood that other embodiments can be realized and that logical and mechanical dimensional changes can be made without departing from the spirit and scope of the invention. Thus, the detailed description herein is presented for purposes of illustration only and not of limitation. For example, the steps recited in any of the method descriptions can be executed in any order and are not limited to the order presented.

Figure 1:
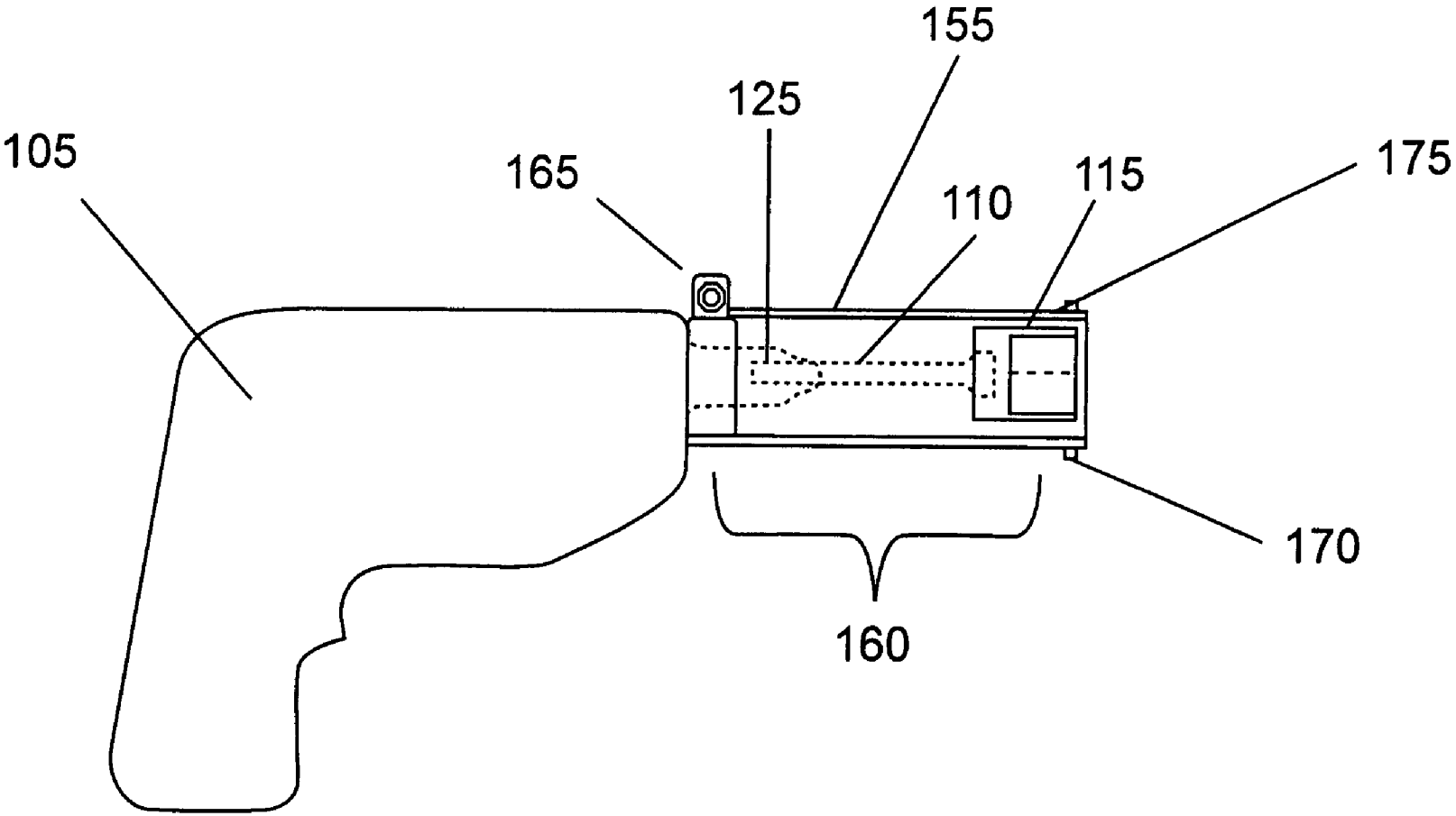
FIG. 1 illustrates a perspective view of an exemplary linkage device in accordance with the invention.

FIG. 1 illustrates an embodiment of a removable starter device in accordance with the present invention. The device can be used to start various equipment including, but not limited to mowers, weed trimmers, hedge trimmers, tillers, power rakes, power blowers, snow blowers, pressure washers, chippers, edgers, sweepers, generators, cultivators, chain saws, air compressors, and the like. The device can also be used to start various vehicles such as outboard boats, snowmobiles, motorcycles, all-terrain vehicles, ultralight aircraft, and the like.

Referring to FIG. 1, an electric drill with removable linkage device is illustrated. The removable linkage device 160 is configured to removably attach to an electric drill 105. Linkage device 160 comprises a tube 155, locking clamp 165 and dowel pins 170 and 175. Tube 155 is configured to house a hex shank socket extension 110 (HSSE) coupled to a chuck 125 of drill 105.

Electric drill 105 can be any type of electric drill, including both cordless and traditional cord drills. In one exemplary embodiment, drill 105 comprises a fourteen volt cordless drill without a reverse mode. Drill 105 can comprise a chuck to receive any size HSSE 110. In one exemplary embodiment, chuck 125 of drill 105 is a ¾ inch chuck.

Tube 155 is configured as a tube having an interior and an exterior diameter. The walls between the interior and exterior diameter can range between approximately 1/32 inch in thickness to ⅛ inch in thickness. Tube 155 can comprise any type of rigid material. For example, in one exemplary embodiment, tube 155 comprises a structurally sound metal, such as, for example, steel, titanium, brass, copper, and/or the like. Tube 155 is configured to extend along the length of HSSE 110, such that it houses substantially all of HSSE 100 within tube 155. For example, tube 155 can be configured to extend lengthwise approximately four inches, and the exterior diameter of tube 155 can be configured to be approximately two inches.

Locking clamp 165 a circular ring that fits around the outside of tube 155 that is open on one side. Extending outward from each edge of the open side of locking clamp 165 are two locking parts configured to receive a clamping device in an opening within the locking parts. The clamping device as described herein, includes, but is not limited to a bolt, a screw, studs and/or the like. As the clamping device is tightened within the two locking parts, the two locking parts come closer together. This locking movement tightens tube 155 around the drill collar.

Figure 2:
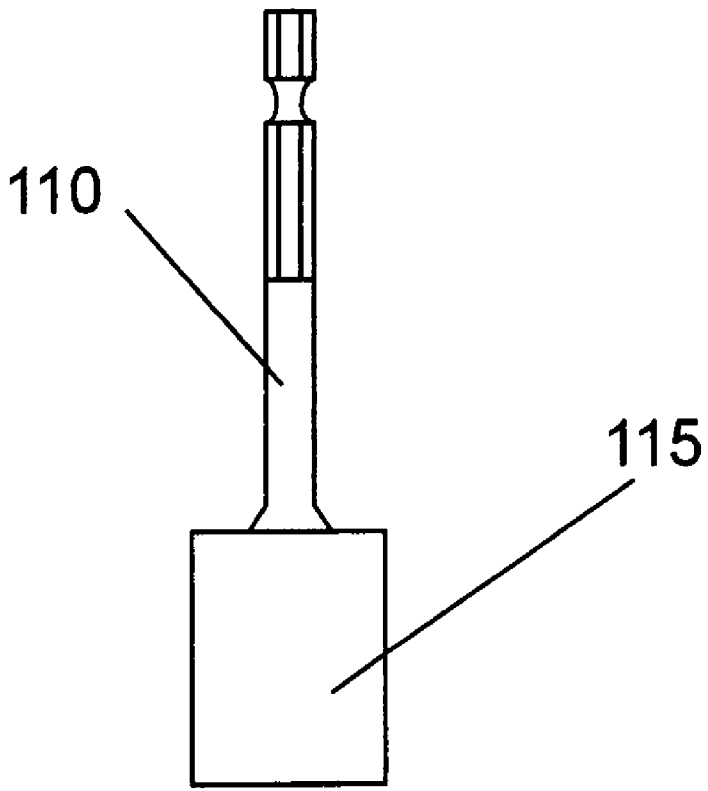
FIG. 2 illustrates a side-perspective view of an exemplary hex shank socket extension adaptor in accordance with the invention.

With additional reference to an exemplary block diagram illustrated in FIG. 2, HSSE 110 comprises a socket 115 that is configured to engage with an existing hex nut of a bolt that secures the flywheel of a gasoline engine to its crankshaft. HSSE 110 is coupled to chuck 125 of drill 105. HSSE 110 and socket 115 are housed substantially within linkage device 160.

Dowel pins 170 and 175 are configured to facilitate locking the electric drill with removable linkage device into place when coupled to the hex nut of a bolt that secures the flywheel of engine 150. Pins 170 and 175 are disposed on opposite sides of tube 155 at the end of tube 155 that is adjacent to socket 115. Dowel pins 170 and 175 can be coupled to tube 155 by any means such as by screwing pins into tube 155, by glue, and/or by affixing pins to tube 155 in any other manner. Dowel pins 170 and 175 can comprise any type of rigid material, such as, for example, wood, PVC, metal and/or the like. In one exemplary embodiment, dowel pins 170 and 175 comprise stainless steel. Dowel pins 170 and 175 can be configured to have any length or diameter to facilitating locking drill 105 and removable linkage device 160 to the crankshaft of an engine. In one exemplary embodiment, dowel pins 150 and 175 are approximately ¼ inch in length and have a diameter of approximately ⅜ inch.

Figure 3:
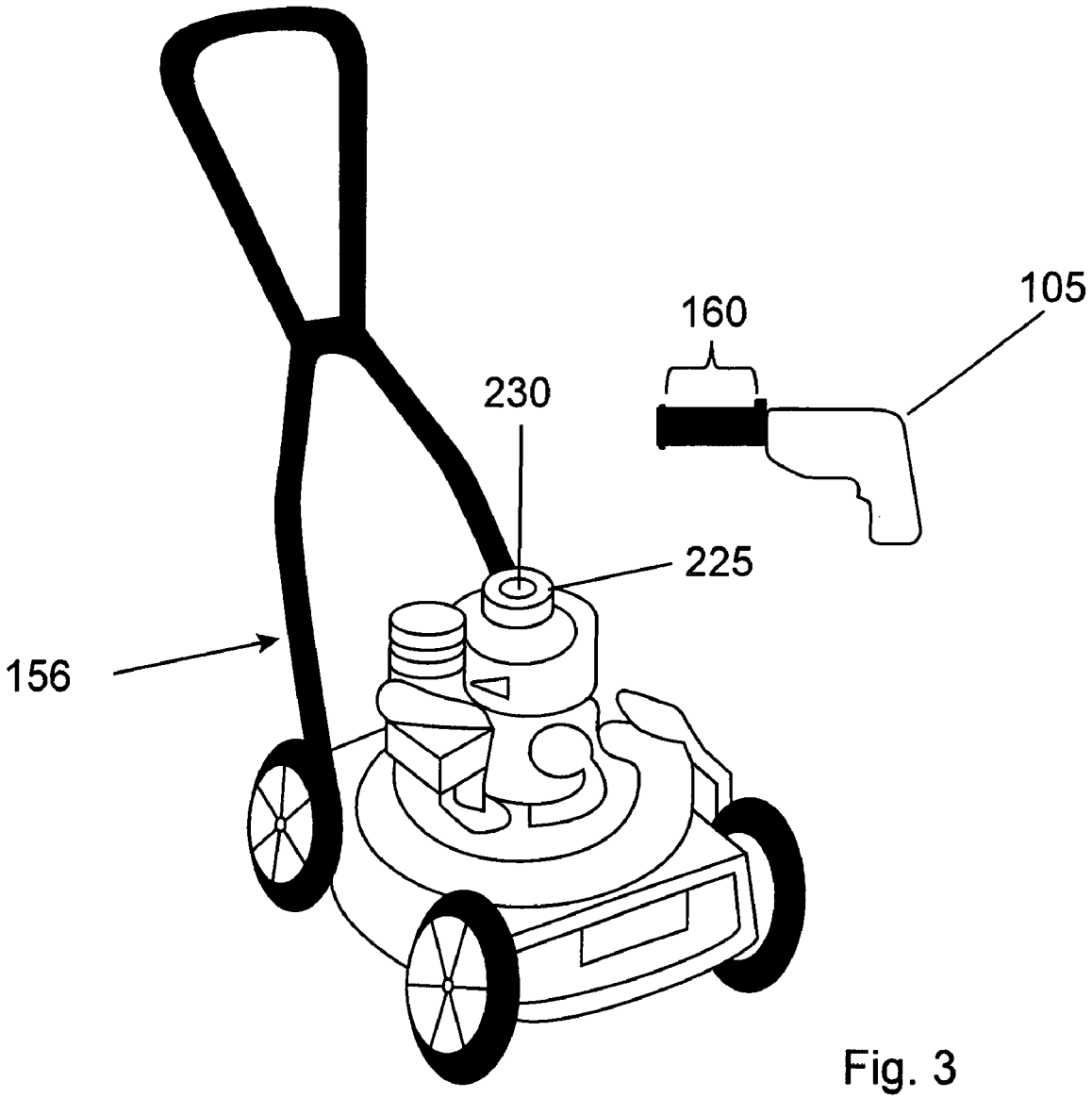
FIG. 3 illustrates a block diagram of an exemplary starter system in accordance with the invention.

With reference to an exemplary block diagram of a starter system illustrated in FIG. 3, removable linkage device 160 can be used to facilitate starting a lawn mower 150. Lawn mower 150 can be started with the rope starter in place and/or with it removed. While a lawn mower is illustrated in FIG. 3, removable linkage device can be used to start any type internal combustion engine powered equipment, described herein.

Lawn mower 150 comprises an engine that comprises conventional engine components, such as, for example, an ignition, a starter, a piston and piston rod assembly, a cylinder, a fuel tank, a crankshaft, a flywheel and the like. The engine is coupled to one or more mower blades. An anchor device 225 is configured to substantially surround the hex nut 230 of a bolt that secures the flywheel of the engine to facilitate locking the electric drill with removable linkage device to engine 150.

Figure 4A:
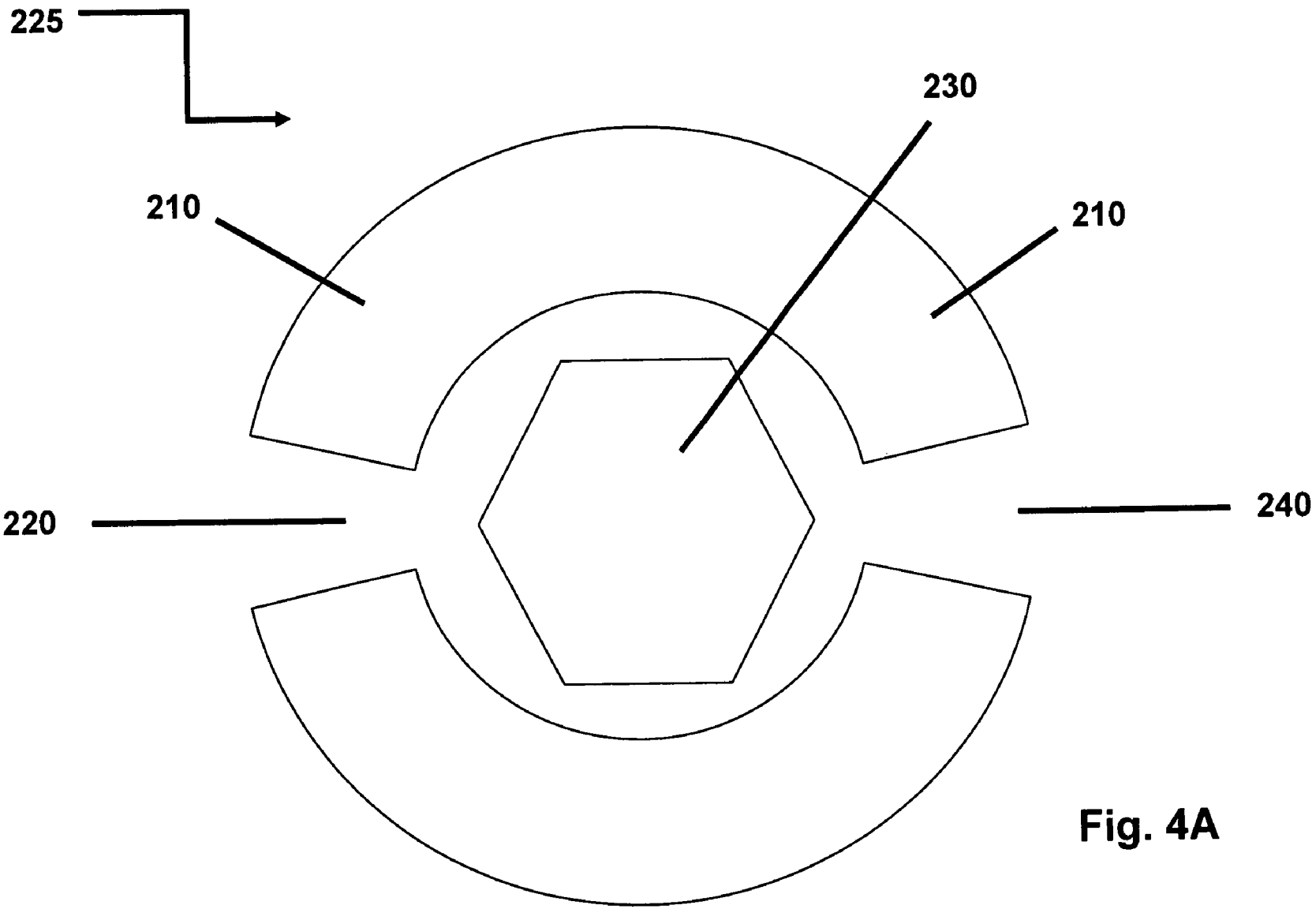
FIG. 4A illustrates an overhead view of an anchor device in accordance with the present invention.

Anchor device 225 can be further explained with reference to an exemplary overhead view depicted in FIG. 4A. Anchor device 225 is configured as two generally hemispherical halves 210 around hex nut 230 that form slots 220, 240 for receiving dowel pins 170 and 175 of device 160. Hemispherical halves 210 of anchor device 225 are configured to form a circle having a diameter slightly larger than the outer diameter of tube 155, such that tube 155 can fit within the circle formed by halves 210. For example, in one exemplary embodiment, halves 210 form a circle having a diameter of four ¼ inches to accommodate tube 155 having an outer diameter of four inches. In addition, anchor device 225 is configured of a height that is approximately the same as that of tube 155. As such, the top of tube 155 is an orifice around which anchor device 225 is introduced. Anchor device 225 can comprise any substantially rigid material described such as a sound metal and/or polyvinyl chloride PVC. Anchor device 225 can be configured to have a length ranging from approximately one to four inches.

Figure 4B:
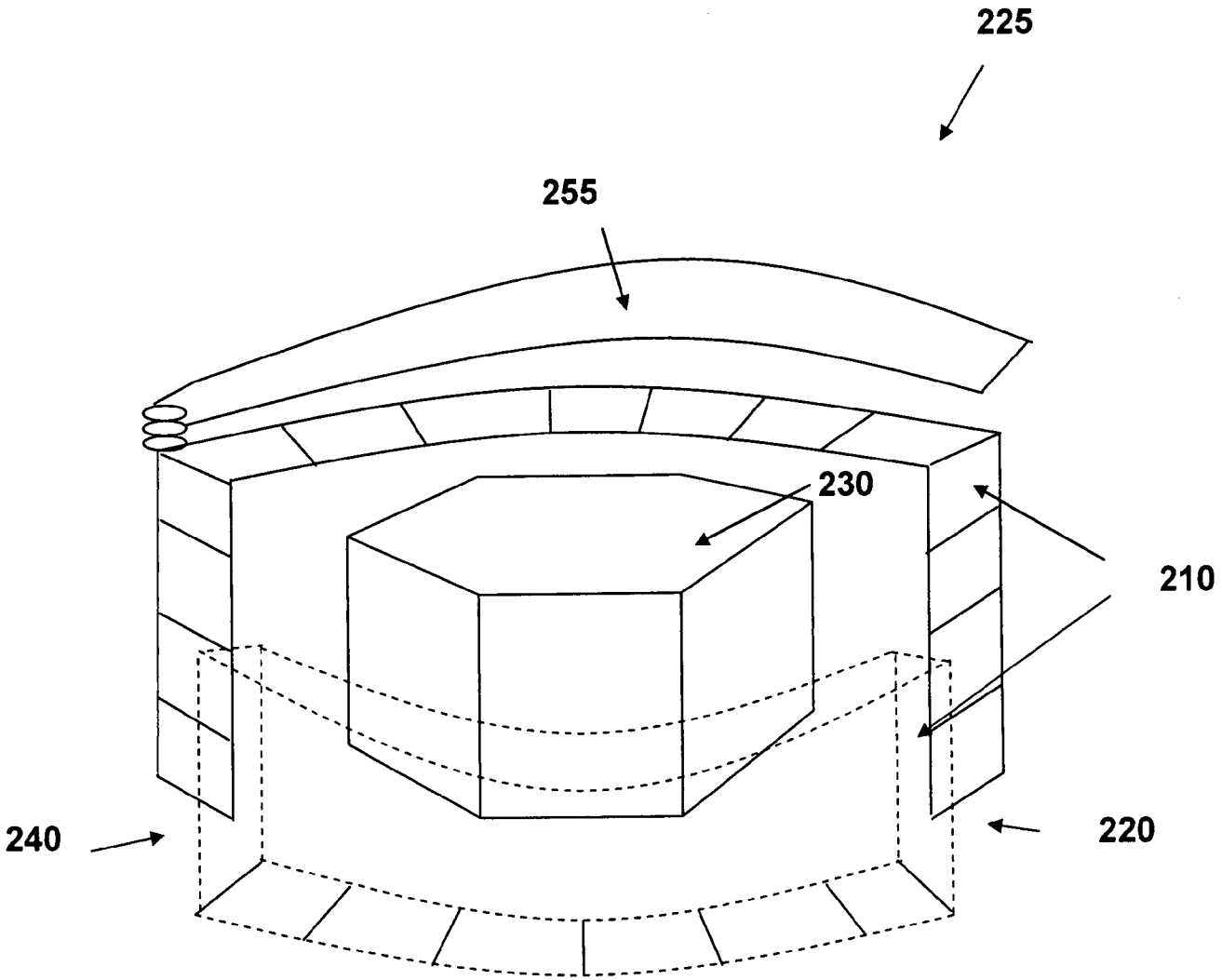
FIG. 4B illustrates a side perspective view of an engine cover in accordance with the present invention.

Anchor device 225 is configured to be coupled to a mower 150 such that anchor 225 is concentric with hex nut 230. Anchor device 225 can be coupled to mower 150 by any manner described herein. In one exemplary embodiment, anchor device 225 is coupled to mower 150 by being part of/encompassed under a molded engine cover 255 and the orifice of the anchor device (FIG. 4B) may be covered by engine cover 255, wherein cover 255 comprises a hinged lid and/or spring operated lid that will return to the closed position as device is withdrawn. In another exemplary embodiment, the height of halves 210 is governed by the configuration of anchor device 225 under molded engine cover 255.

With reference again to FIG. 1, removable linkage device 160 is used by first coupling HSSE 110 to chuck 125 of drill 105. HSSE 110 is further coupled to socket 115. Tube 115 of removable linkage device 160 is then coupled to drill 105 by placing tube 155 around HSSE 110 and locking tube 155 to drill 105 using locking clamp 165. The dowel pin 170, 175 end of tube 155 is then positioned within anchor 225 such that socket 115 engages with hex nut 230 and dowel pins 170 and 175 engage with slots 220 and 230. Drill 105 is then powered on. The rotational energy of HSSE 110 by drill 105 is then transferred to hex nut 230, which in turn rotates the crankshaft of the mower engine to start the engine. Once the engine has started running, drill 105 with linkage device 160 can be removed from anchor 225.

It should be apparent that an invention has been provided with significant advantages. The removable linkage device of the present invention allows an engine having a rotary crankshaft to be started quickly and safely.

The present invention has been described above with reference to various exemplary embodiments. However, those skilled in the art will recognize that changes in modifications may be made to the exemplary embodiments without departing from the scope of the present invention. As used herein, the terms "comprises," "comprising," and/or any other variation thereof, are intended to cover a non-exclusive inclusion, such that a process, method, article, and/or apparatus that comprises a list of elements does not include only those elements but may include other elements not expressly listed and/or inherent to such process, method, article, and/or apparatus. Further, no element described herein is required for the practice of the invention unless expressly described as "essential" and/or "critical."

I claim:

1. A device for starting an engine having a rotary crankshaft, the device comprising:

a drill comprising a chuck;

a hex shank socket extension coupled to the chuck;

a removable linkage device comprising a tube having two dowel pins disposed on opposite sides of the tube at a first end on the tube, wherein a second end of the tube is configured to be coupled to the drill and wherein the tube is configured to encircle the hex shank socket; and an anchor device encircling a hex nut of a bolt securing a flywheel of the engine, the anchor device comprising two hemispherical sidewalls that form a circle, and wherein the hemispherical sidewalls further form two elongate slots on opposite sides of the circle;

wherein the tube is configured to engage within the circle and wherein the two dowel pins are configured to engage with the two elongate slots of the circle.

2. The device of claim 1, wherein the drill comprises at least one of a cordless and electric drill.

3. The device of claim 1, wherein the tube comprises a structurally sound metal.

4. The device of claim 1, further comprising a locking collar to facilitate coupling of the tube to the drill.

5. The device of claim 1, wherein the tube is configured to be approximately four inches in length.

6. The device of claim 5, wherein the tube is configured to have an outer diameter of two inches.

7. The device of claim 1, wherein the two dowel pins are each configured to have a length of approximately ¼ inch and a diameter of approximately ⅜ inches.

* * * * *